US008904563B2

(12) United States Patent
Lambertz

(10) Patent No.: US 8,904,563 B2
(45) Date of Patent: Dec. 9, 2014

(54) CLOTHING ITEM

(75) Inventor: Bodo W. Lambertz, Pfaffikon (CH)

(73) Assignee: X-Technology Swiss GmbH, Wollerau (CH)

( * ) Notice: Subject to any disclaimer, the term of this patent is extended or adjusted under 35 U.S.C. 154(b) by 69 days.

(21) Appl. No.: 13/138,877

(22) PCT Filed: Apr. 16, 2010

(86) PCT No.: PCT/EP2010/002354
§ 371 (c)(1),
(2), (4) Date: Nov. 7, 2011

(87) PCT Pub. No.: WO2010/118884
PCT Pub. Date: Oct. 21, 2010

(65) Prior Publication Data

US 2012/0047619 A1 Mar. 1, 2012

(30) Foreign Application Priority Data

Apr. 17, 2009 (DE) ..... 20 2009 005 651 U

(51) Int. Cl.

| | |
|---|---|
| ***A41D 13/00*** | (2006.01) |
| ***A41D 27/28*** | (2006.01) |
| *A41D 3/00* | (2006.01) |
| *A41D 13/002* | (2006.01) |

(52) U.S. Cl.
CPC ..... *A41D 27/28* (2013.01); *A41D 2500/10* (2013.01); *A41D 2400/22* (2013.01); *A41D 2400/20* (2013.01); *A41D 3/00* (2013.01); *A41D 2400/62* (2013.01); *A41D 13/002* (2013.01)
USPC ..... 2/69

(58) Field of Classification Search
USPC ..... 2/69, 458, 87, 82
See application file for complete search history.

(56) References Cited

U.S. PATENT DOCUMENTS

| | | | | |
|---|---|---|---|---|
| 2,631,290 | A * | 3/1953 | Klepper | 2/87 |
| 5,337,418 | A * | 8/1994 | Kato et al. | 2/456 |
| 5,708,985 | A * | 1/1998 | Ogden | 2/239 |
| 7,117,537 | B2 * | 10/2006 | Mazzarolo | 2/69 |
| 7,856,668 | B2 * | 12/2010 | Demarest et al. | 2/69 |
| 2005/0086721 | A1 * | 4/2005 | Lambertz | 2/69 |

* cited by examiner

*Primary Examiner* — Amber Anderson
(74) *Attorney, Agent, or Firm* — Olson & Cepuritis, Ltd.

(57) ABSTRACT

The invention relates to a clothing item, particularly for sports activities, made of water-proof and wind-proof material, comprising a climate membrane. Regions (7, 8) made of highly elastic woven fabric which has temperature equalizing properties are provided in the material.

3 Claims, 3 Drawing Sheets

CLOTHING ITEM

RELATED APPLICATION

Figure 1:
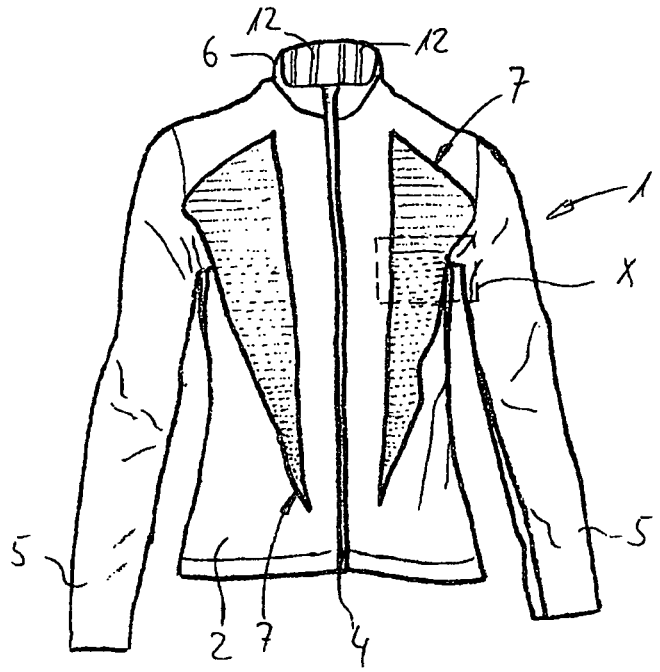

This is a national stage filing of International Application Serial No. PCT/EP2010/002354 filed Apr. 16, 2010.

The invention relates to an item of clothing of waterproof and wind-proof material, particularly for sports activities, which contains a climate membrane.

Because of sweat accumulating during sports activities, particular requirements in regard to the removal of sweat or the removal of sweat vapor, as the case may be, are placed on items of clothing for sports activities. At the same time, the items of clothing should be water-repellent during activities in the open in order to offer sufficient protection during moist weather and, at the same time, to protect a sportsman against an excessively rapid cooling off after the sports activity.

It is known to manufacture items of clothing for sports activities from multi-layer materials in which a climate membrane is laminated on an outer shell, on which a loose lining, generally of fabric or mesh, is positioned on the inside. The lining can also be laminated, together with the outer shell and the climate membrane, into a contiguous fabric in the form of a three-layer laminate.

The known items of clothing with membranes have the problem that the breathability is slight during heavy physical activity. Items of clothing provided with membranes are, of course; able to provide a certain breathability, which is brought about through the interaction of water-tightness and breathability; that is to say, a partial pressure, which should make the breathing of the membrane possible, is built up under the item of clothing. This breathability is limited, however. Studies have shown that significant ventilation occurs under the clothing during sports activities through the opening at the throat. A continuous draft, which essentially controls the airing and ventilation, thereby arises at the throat. The consequence of the deficient breathability is that the high humidity on the internal side of the item of clothing condenses, so that condensed water runs off on the internal sides. The extraordinarily high humidity that results under the item of clothing leads to a saturation, which brings about a loss of performance during the wearing of the jacket.

The known items of clothing based on a climate membrane have the disadvantage, moreover, that because of the inelasticity of the climate, membrane, they are not stretchable. This has the result that the items of clothing are, insofar as these are not customized products, frequently either in too-tight contact with the body or else are placed far away from the body. Because of the great multiplicity of body sizes and dimensions, a high accuracy of fit of the products can only be achieved by the manufacture upon great effort, and is therefore more expensive. In addition, the inelasticity of the clothing during sports activities frequently turns out to be uncomfortable and disruptive.

The invention is intended to provide help in this regard. The task that forms the basis of the invention is that of creating an item of clothing, particularly for sports activities, in which a significantly improved airing and ventilation and, at the same time, the requirements for wind- and water-tightness placed on an item of clothing, are fulfilled and, in addition, a good freedom of movement is made possible. This task is solved in accordance with the invention through the fact that areas of highly elastic fabric that have temperature-equalizing properties are provided in the material.

An item of clothing is created by means of the invention, particularly for sports activities, which provides a significant improvement in regard to the freedom of movement as well as the climate inside the item of clothing with, at the same time, tightness against wind and water. In this way, a loss of performance through excessively high humidity inside the item of clothing is prevented. Because of the improved freedom of movement, the wearing comfort is additionally increased.

Figure 2:
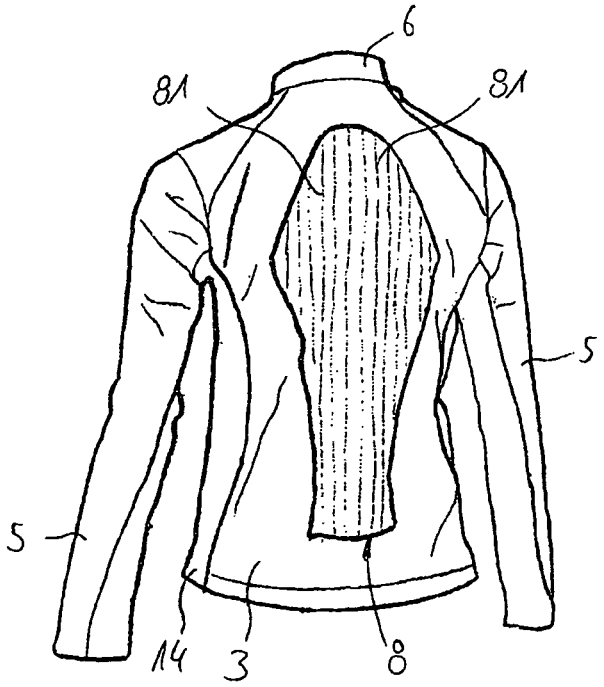
Figure 3:
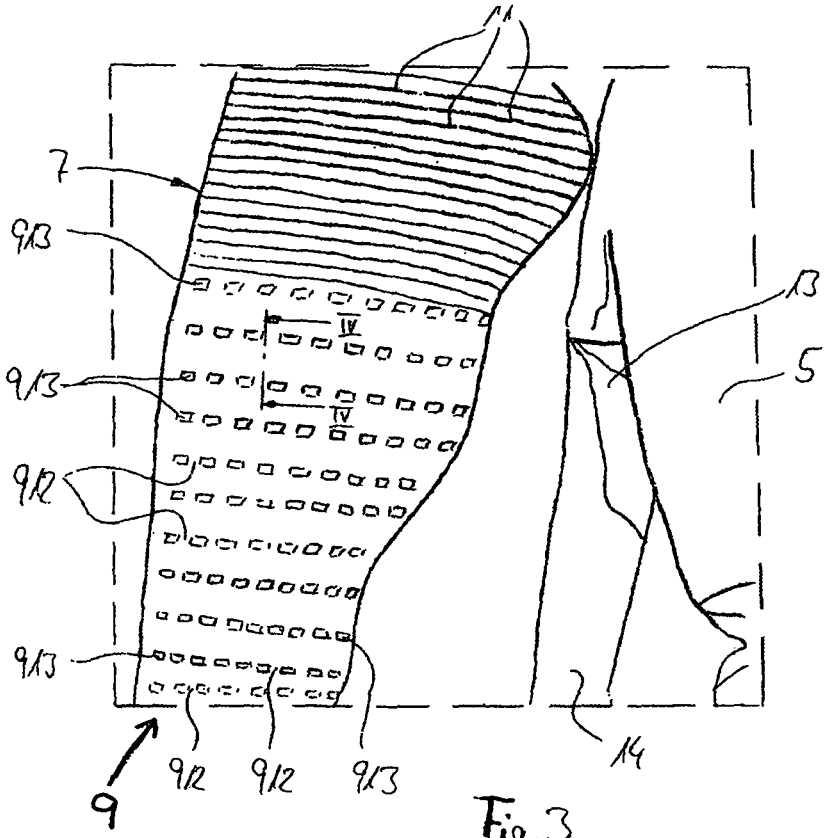
Figure 4:
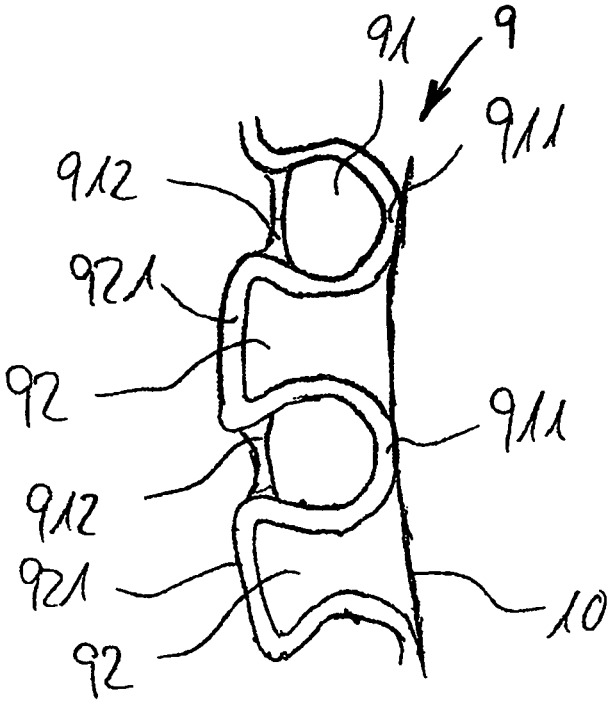

In a further development of the invention, the areas consist of a three-dimensional fabric. The three-dimensional fabric, on the one hand, offers the possibility of creating air pockets that prevent a cooling off in connection with sports activities and, on the other hand, a targeted transport of warm air is possible during sports activities through the three-dimensional design. Other further developments and embodiments of the invention are stated in the remaining sub-claims. One example of implementation of the invention is depicted in the diagrams and is described individually in the following. The diagrams depict the following:

FIG. 1A view from the front of an item of clothing in the form of a jacket;

FIG. 2 The view of the jacket depicted in FIG. 1, viewed from the rear;

FIG. 3 The detail "X" from FIG. 1 in an enlarged scale; and:

FIG. 4 The section along the line IV-IV in FIG. 3.

The item of clothing 1 selected as an example of implementation is described by means of a jacket. The jacket 1 is manufactured from a wind- and water-repellant material. The material contains a climate membrane. The jacket 1 is provided in its interior with a lining of mesh fabric, which is not depicted. The fabric is light and has comfortable wearing properties, which results in a high level of wearing comfort. The jacket 1 has a front side 2 and a rear side 3. The front side 2 can be closed with a zipper 4. The jacket 1 additionally has a sleeve 5, and is provided with a collar 6.

Areas 7 and 8, which are made from highly elastic fabric that has temperature equalizing properties, are provided in the wind- and water repelling material having the climate membrane. The first area 7 is thereby positioned on the front side of the jacket 1; the second area 8 is positioned on the rear side 3 of the jacket 1. Areas 7 and 8 are produced from knit material. They consist of a three-dimensional fabric. The fabric thereby forms channels 9, which are oriented horizontally and/or vertically.

The first area on the front side of the jacket 1 provides a type of a fresh air valve for the purpose of airing, among other points. At the same time, area 7 has insulating properties, as clarified in individual terms in the following by means of the structure of the channels 9.

The channels 9 are to be distinguished into external channels 91 and internal channels 92, as is clarified in FIG. 4. The internal channels 91 are positioned with the base of the channel 911 on the item of clothing located under the jacket 1, which is marked in FIG. 4 with "10". As long as the jacket 1 is worn directly on the skin, the base of the channel 911 is not placed on the item of clothing 10, but rather on the skin. The channels 91 have an approximately circular construction. They are constructed in open form on the side oriented away from the item of clothing 10. The channels 91 are traversed at regular intervals by dividers 912, through which essentially rectangular openings 913 are formed (FIG. 3).

The internal channels 92 are positioned between the external channels 91. The channels 92 are formed by the wall of the channels 91, by the item of clothing 10, or by the skin during the direct wearing on the skin, as well as flat sections 921. Because of the closed, construction of the channels 92, these serve as insulating pads, particularly during resting phases after sports activity, since warm air collects in them and an insulation against the cold acting from the outside is consequently brought about. The external channels 91, on the other hand, serve for the rapid and effective evaporation of the sweat that arises during sports activity. The sweat absorbed by the base of the channel 911 thereby has the possibility of evaporating directly into the air located in the channels 91, so that a very good removal of sweat is thereby made possible.

A structure made from knit material fabric is provided in area 7 in the example of implementation, above the channel 9, as the result of which ribs 11 are formed. The ribs 11 are, in a manner comparable to the channels 91, located on the item of clothing 10 positioned under the jacket 1 or, when wearing it directly on the skin, upon the same. A free space, which likewise has the basic form of a channel, is thus formed between each of the ribs 11. As the result, a space is also created here between the ribs, as well as the item 10 positioned under the jacket 1, within which space warm air can collect, so that an air cushion, which prevents a cooling, is created during cooling off after sports activities. At the same time, the rib structure offers the possibility of a very good expansion in parallel to the oriented ribs. As the result, the freedom of movement of the jacket is improved considerably.

The second area 8 in the rear side 3 is formed by ribs 81. The ribs 81 are formed in a manner comparable to the ribs 11. They are oriented vertically. The item of clothing 10 located between adjacent ribs 81 and the space under the jacket or the space under the skin, as the case may be, likewise serves to collect body heat after the ending of sports activities in order to prevent a cooling off. At the same time, the vertical alignment of the ribs 81 offers the possibility during sports activities, of transporting the physical effect of the rising of warm air from the warm and moist air radiated by the body upwardly and, in this way, of contributing to a ventilation.

For the continuation of the transport of the warm and moist air upwardly, guide units 12, which provide a predefined distance between the internal side of the jacket 1 and the item of clothing 10 located underneath the same or the skin, as the case may be, are positioned on the internal side of the jacket 1 above the area 8. The guide units 12 are positioned in such a way that an air stream, which diverts the moist and warm air upwardly, is guided over the predefined areas between the guide units 12. This contributes to an additional improvement of the climatization. For the additional improvement of the climatization; the possibility exists of providing airing and ventilation 13 in the areas of the armpits of the jacket 1. The airing and ventilation 13 is preferably provided by means of knit fabric. By this means, the entrance and discharge of air into the jacket 1 or out of the jacket 1, as the case may be, is made possible and, specifically so, in an area that has the greatest accumulation of sweat. Air circulation elements 14 can additionally be positioned laterally between the front side 2 and the rear side 3.

The item of clothing in accordance with the invention makes possible both an outstanding freedom of movement as well as very good climatization during sports activities. The freedom of movement is particularly brought about through the fact that the first area 7 corresponding to the example of implementation, makes possible an expansion in the vertical direction and the area 8 makes possible an expansion in the horizontal direction. By means of the configuration of areas 7 and 8, which have their greatest width in the areas of the shoulder blades or the chest, respectively, the maximum expansibility is brought about in the upper area of the upper body. This corresponds to the requirements for the expansibility that are brought about because of arm movements during sports activities. The item of clothing is thus optimally adjusted to conditions during sports activities.

The same is true for the climatization of the item of clothing. Through the use of fabric with temperature equalizing properties, as well as the three-dimensional configuration with inclusion of the channels formed that has been described, an airing and ventilation in accordance with the requirements is brought about. As the result, a very comfortable climate is created within the jacket, even during the most strenuous physical exertion, so that the performance of the individual sportsman is not negatively influenced. At the same time, the fabric provides an insulation in order to prevent a cooling off in connection with sports activities.

The invention claimed is:

1. A jacket for sports activities adapted to be worn over the upper body of a user, made of waterproof and wind-proof material, which allows for the removal of sweat or sweat vapor from the user of the jacket when worn characterized in that, the jacket includes an openable front side a rear side, and a vertical longitudinal axis extending from the user's head to the user's feet, a first knitted area positioned on the front side and a second knitted area positioned on the rear side, the first knitted area defining a first set of alternating ribs and channels substantially traversing the longitudinal axis, and the second knitted area defining a second set of alternating ribs and channels substantially parallel to the longitudinal axis; and further comprising spaced, elongated guide units positioned on a rear interior surface of a collar area of the jacket above the second knitted area; the guide units being substantially parallel and vertically oriented with respect to the torso of the user when worn, the guide units being configured to provide a predefined distance between the interior surface of the collar area of the jacket and the user or the clothing of the user such that space between the guide units provides a path for air from the interior of the jacket to flow out through the collar area when worn.

2. The jacket of claim 1, characterized in that, individual channels of the first set of alternating ribs and channels are traversed at regular intervals by dividers.

3. The jacket of claim 1, characterized in that, the jacket includes armpits and an airing and ventilation passage is provided in the area of each armpit of the jacket.

* * * * *